United States Patent [19]

Shepherd

[11] 4,318,071

[45] Mar. 2, 1982

[54] INTERFACE RELAY FOR HIGH CURRENT EQUIPMENT

[75] Inventor: Glen C. Shepherd, Johnson City, Tenn.

[73] Assignee: Texas Instruments Incorporated, Dallas, Tex.

[21] Appl. No.: 137,338

[22] Filed: Apr. 4, 1980

[51] Int. Cl.[3] ..... H01H 61/00; H01H 71/18

[52] U.S. Cl. ..... 337/136; 337/14; 337/135; 60/528

[58] Field of Search ..... 337/14, 15, 102, 107, 337/123, 131, 135, 136, 139, 141; 60/528; 236/101 E, 101 R

[56] References Cited

U.S. PATENT DOCUMENTS

| | | | |
|---|---|---|---|
| 3,080,464 | 3/1963 | Kurz | 337/141 |
| 3,500,634 | 3/1970 | Waseleski, Jr. et al. | 60/528 |
| 3,514,733 | 5/1970 | Staples | 337/135 |
| 3,904,111 | 9/1975 | Petersson | 236/101 R |

*Primary Examiner*—Harold Broome

*Attorney, Agent, or Firm*—James P. McAndrews; John A. Haug; Melvin Sharp

[57] ABSTRACT

Disclosed is a relay for high current equipment, such as, for example, an electric range. The relay provides the interface between the solid state electronics and the high wattage electric heating elements. The relay is comprised of a frame having a non-electrically conductive, flexible substrate, such as a plastic substrate supported at its ends with a shallow V cross section. The substrate has conductive heater elements formed thereon with heater terminals connected to said elements. The plastic substrate has a high coefficient of thermal expansion. A biasing member in contact with the apex of the plastic substrate transmits forces between the substrate and a switch assembly, either creep or snap acting. The upper switch arm preloads or couples a force between the biasing element and the plastic substrate causing a shallow V to be formed in the substrate. When current is applied to the heater terminals and heats the heater element, the substrate expands. This expansion of the plastic substrate is amplified into a larger displacement of the apex of the V due to the geometry of this construction. The motion with amplification of the plastic substrate causes the switch to change from a first state to a second state. When current is removed from the heater elements, the plastic cools and contracts causing the switch to change back to its first state.

28 Claims, 16 Drawing Figures

ASSUME:

KAPTON EXPANSION
$2 \times 10^{-5}$ IN./IN./°C
KAPTON LENGTH = 3 IN.
KAPTON TEMP. = 200° C.

KAPTON HEATED EXPANDS
$2 \times 10^{-5} \times 3 \times 200 = .012$ INCHES
$\frac{1}{2} \times .012 = .006$ INCHES

INTERFACE RELAY FOR HIGH CURRENT EQUIPMENT

This invention relates to improved relays and more particularly to relays utilizing thermal expansion of polymeric material for obtaining motion amplification to produce switch state changes.

Present state of the art in relays used for interface between low power input control circuits and high power circuit loads have been magnetic coil relays, heated bimetal type switches or hot wire relays. These relays have certain disadvantages such as the magnetic coil relay and bimetal switches being very expensive whereas the hot wire relay requires special low voltage power supplies.

Accordingly, it is an object of the present invention to provide a relay capable of operation at any desired voltage to interface between a low power input control circuit and a high voltage/current load.

Another object of the present invention is to provide an interface relay which is both inexpensive, reliable and easy to manufacture.

Another object of the present invention is to provide an interface relay which produces substantial amplification of motion responsive to small thermal expansions.

A still further object of the present invention is to provide an interface relay which is voltage compatible with any solid state electronics input control circuit without modification of the switch design or physical size of the relay.

Another object of the present invention is to provide a relay which can be made voltage compatible with only changes made in heater resistivity.

Another object of the present invention is to provide a relay having moderately fast response time.

Other objects and features of the invention will become more readily understood from the following detailed description and appended claims when read in conjunction with the accompanying drawings, in which like reference numerals designate like parts throughout the FIGURES thereof, and in which:

Figure 8A:
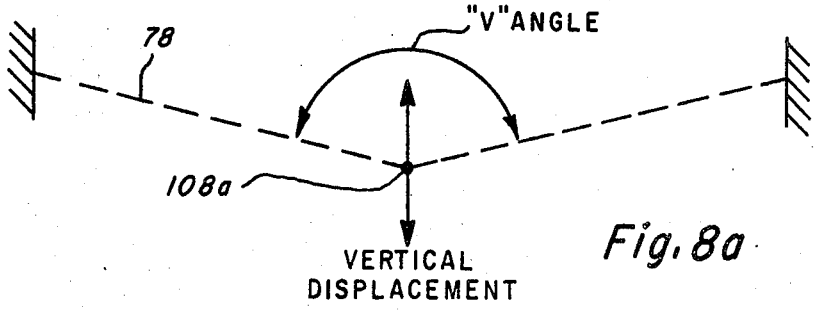
Figure 8B:
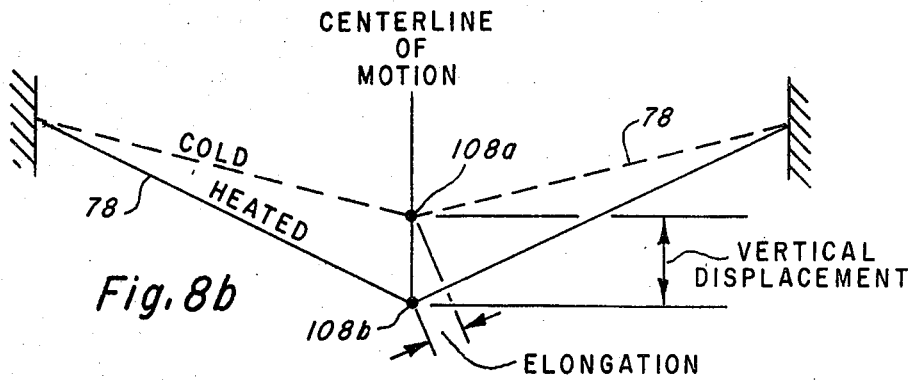

FIGS. 8*a* and 8*b* show side views of the substrate in the cold and heated conditions.

Figure 9A:
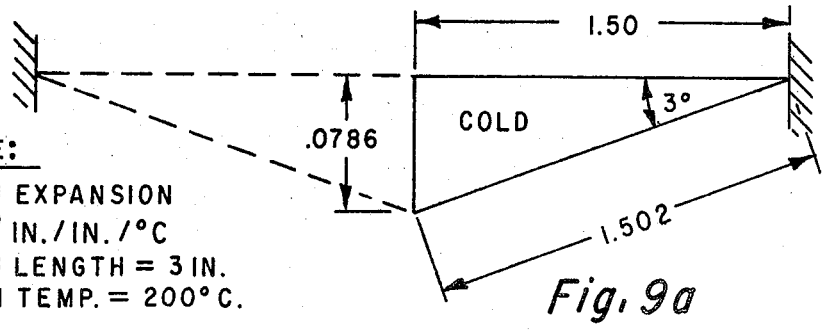
Figure 9B:
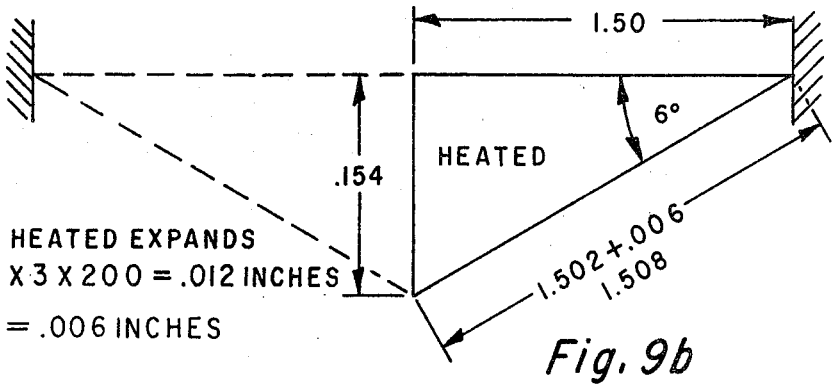

FIGS. 9*a* and 9*b* illustrate the thermal expansion and vertical displacement of the substrate in the cold and heated conditions.

Figure 10:
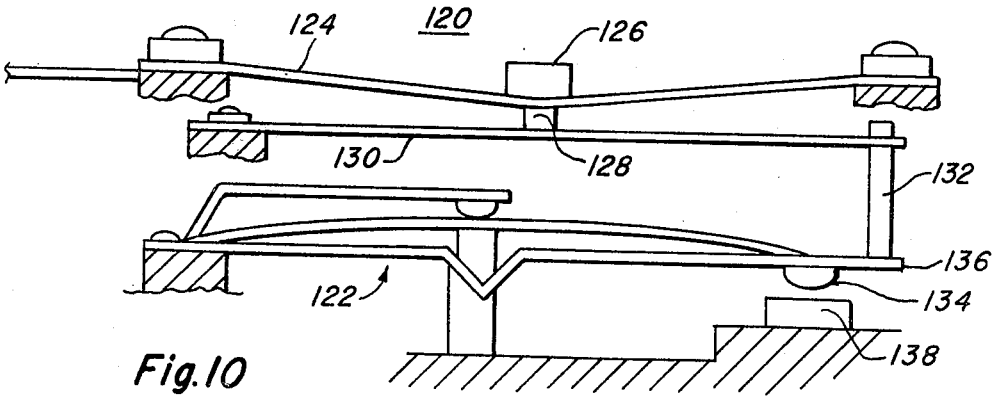

FIG. 10 is a side view of the relay according to the present invention using a snap acting switch.

Figure 11A:
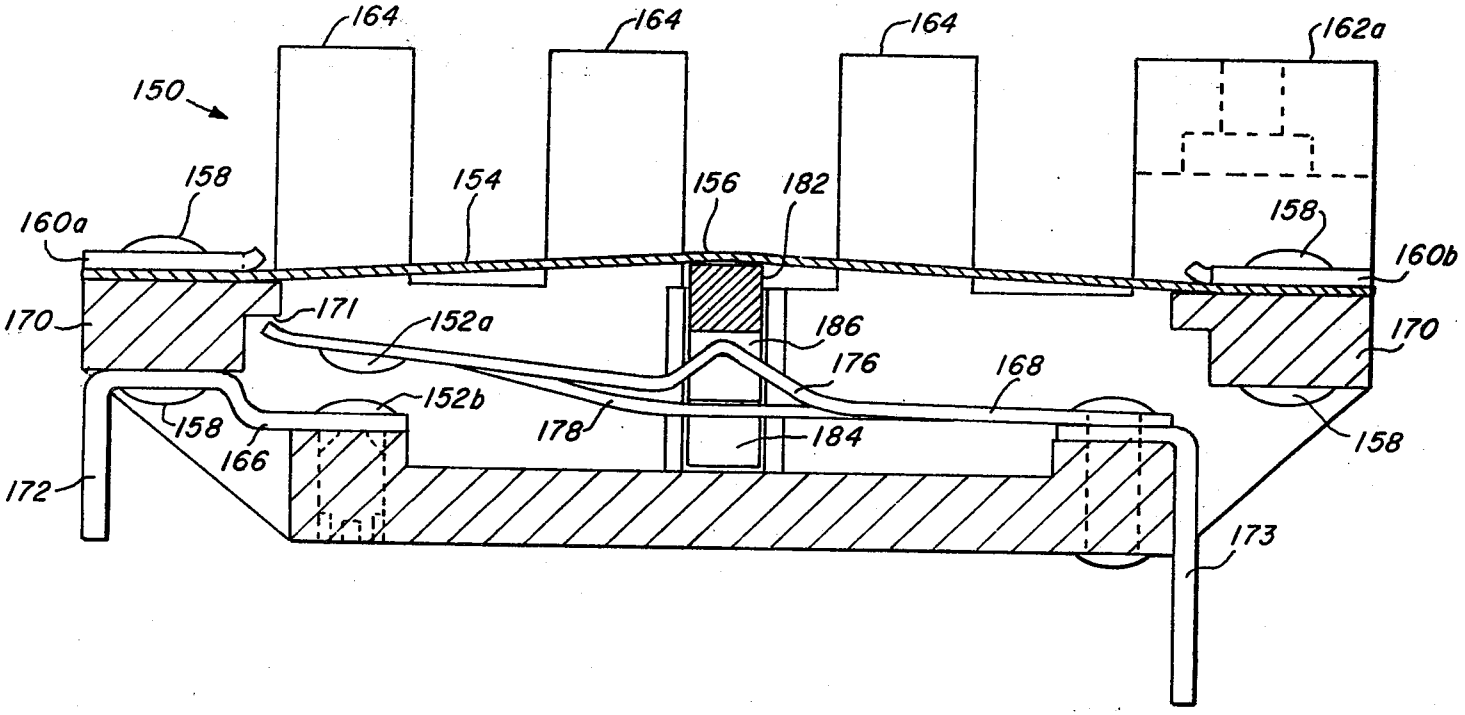
Figure 11B:
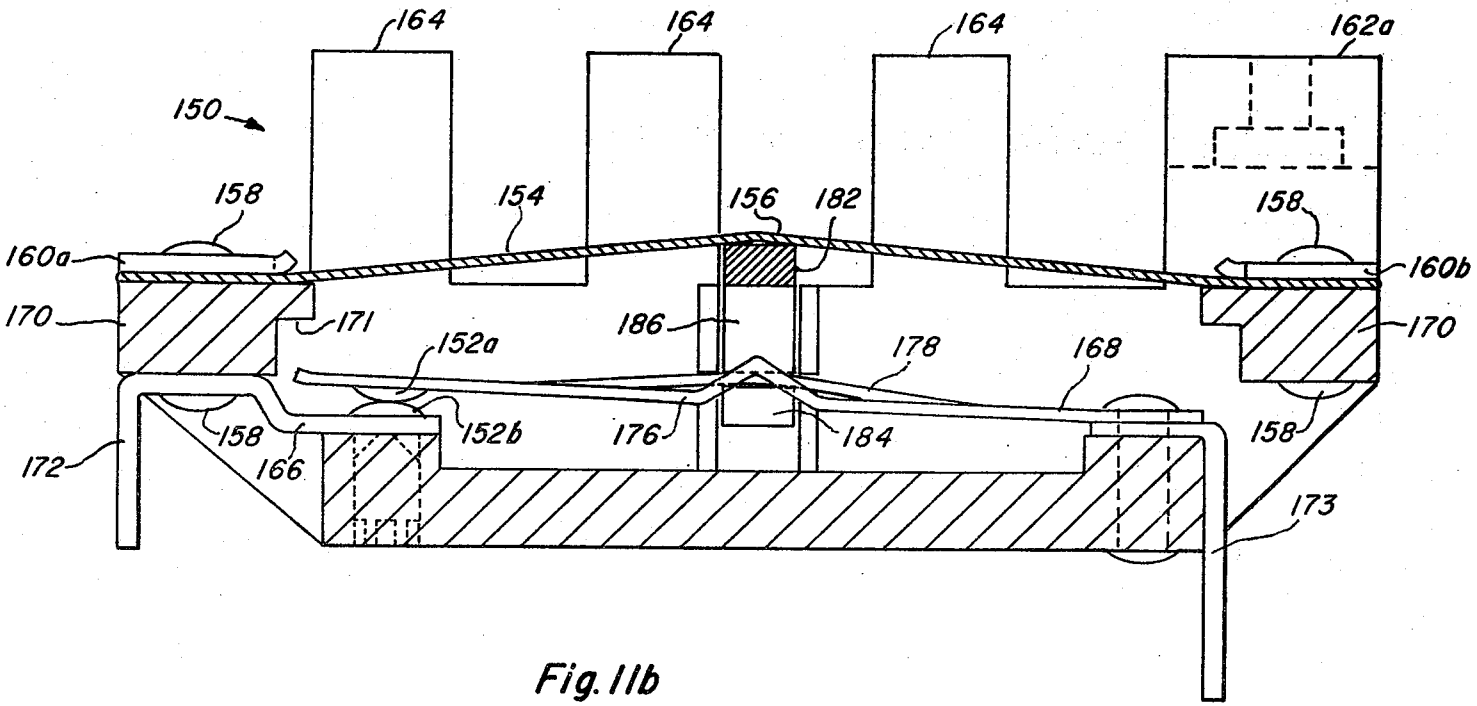

FIGS. 11*a* and 11*b* illustrate side views of another embodiment of the relay according to the present invention using a snap acting switch configuration in the cold and heated conditions.

Figure 12:
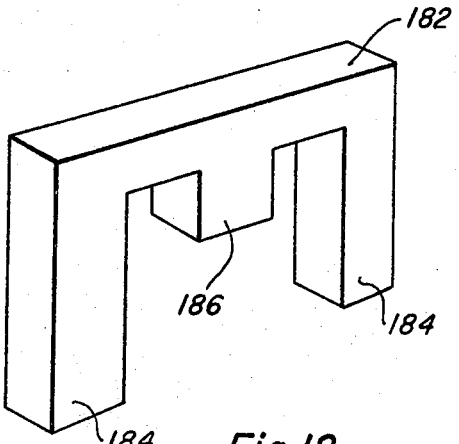

FIG. 12 is a perspective view of the biasing member utilized in the relay of FIGS. 11*a* and 11*b*.

Figure 13:
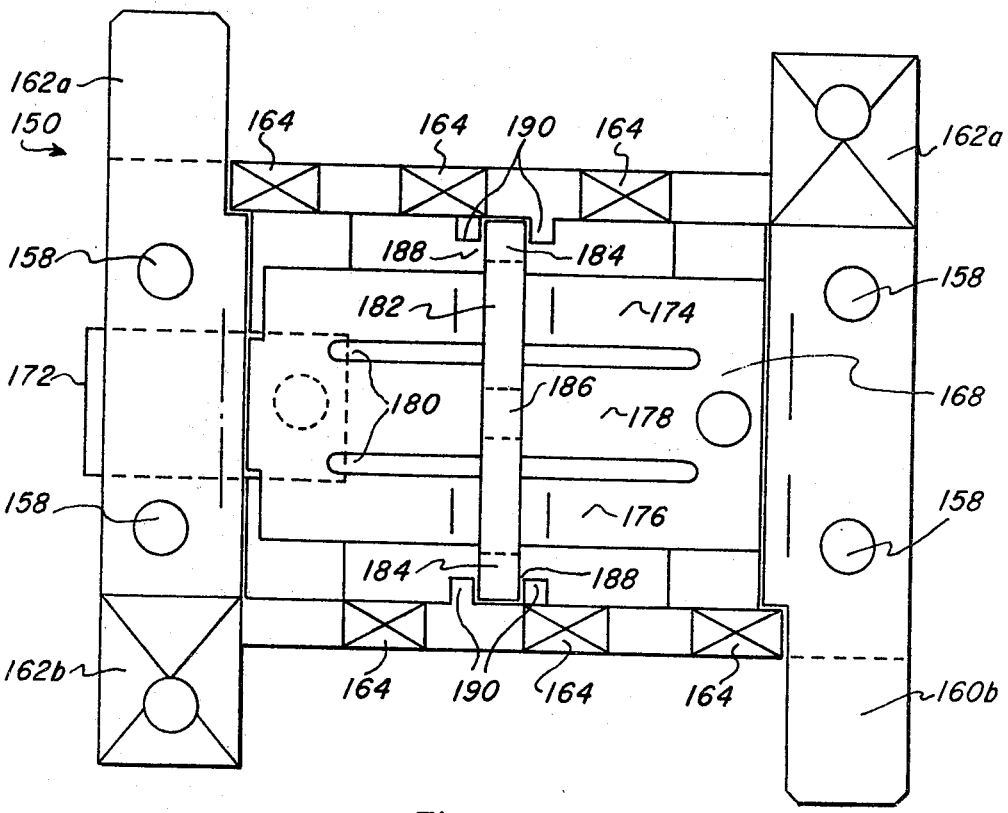

FIG. 13 is a top view of the relay illustrated in FIGS. 11*a* and 11*b* but with the substrate deleted for purposes of clarity.

Figure 1:
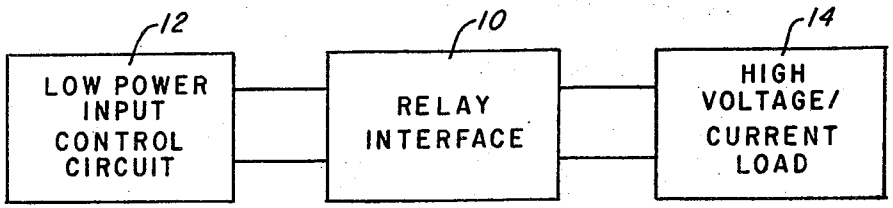
FIG. 1 is a block diagram of the system utilizing an interface relay.

Referring now to FIG. 1 a relay interface 10 changes states responsive to signals from low power input control circuit 12. When relay 10 changes states, high current/voltage is allowed to flow through load circuit 14; typical examples of load circuit 14 would be the heating elements in an electric range or the like, compressors/-motors, and power consuming elements within furnaces and household appliances.

Figure 2:
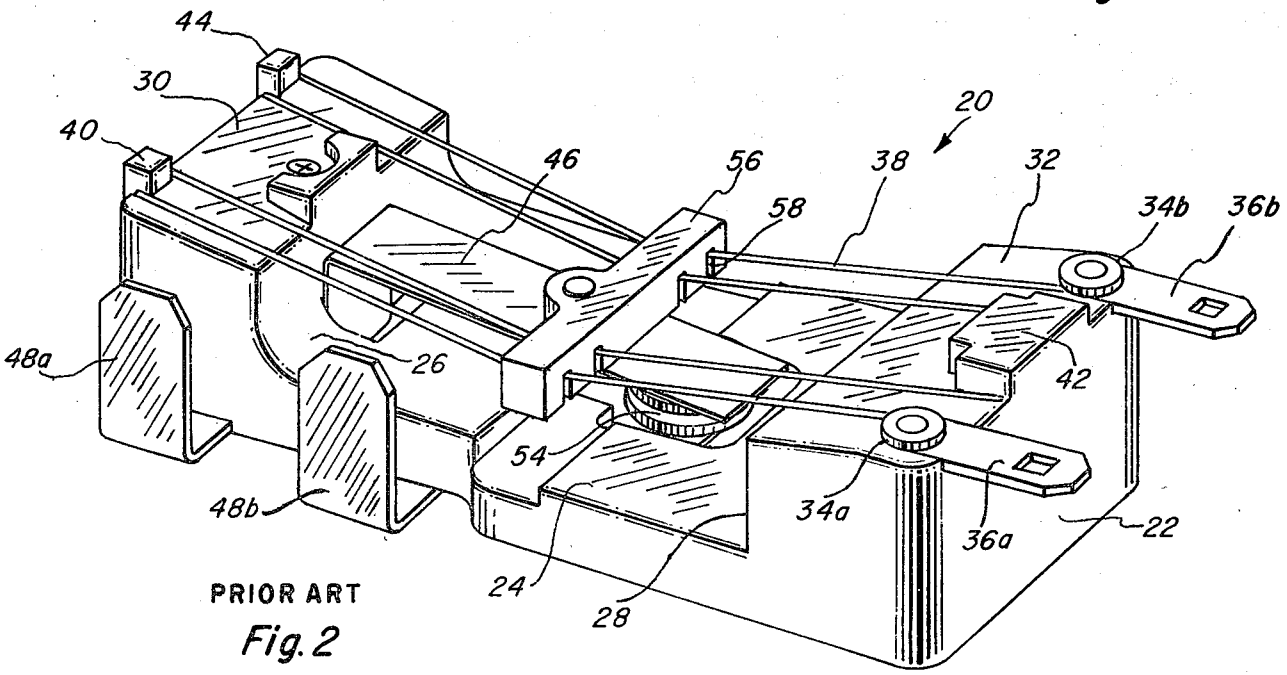
PRIOR ART Fig. 2
FIG. 2 is a top perspective view of a prior art hot wire relay.
Figure 3:
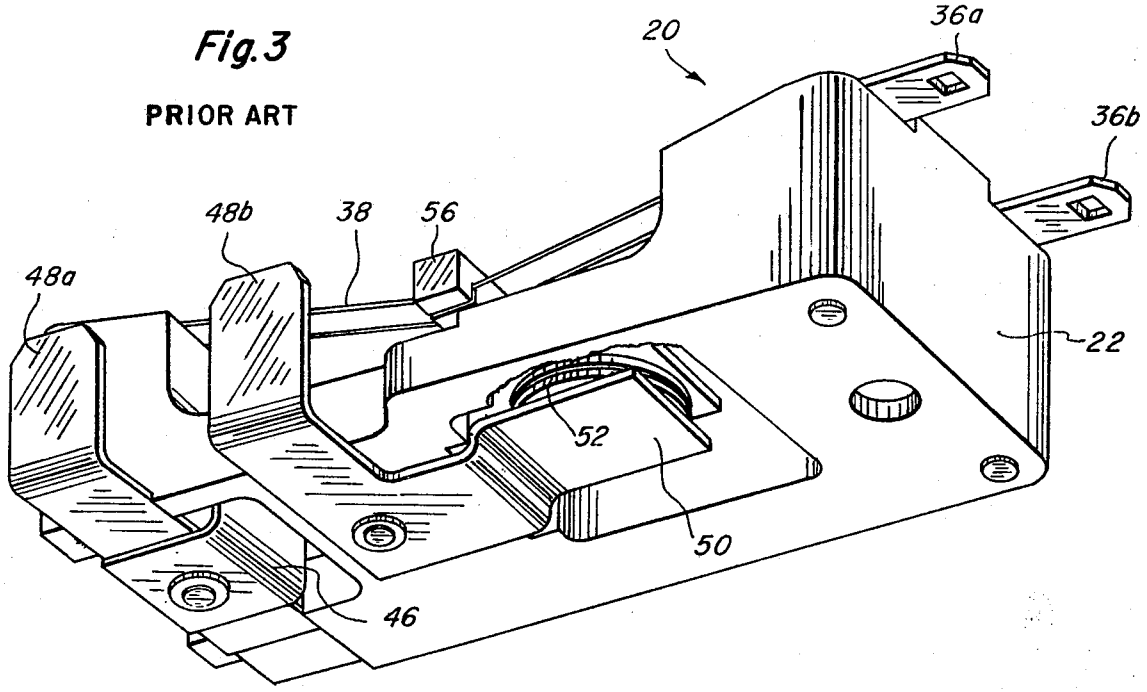
Fig.3 PRIOR ART
FIG. 3 is a bottom perspective view of the prior art hot wire relay of FIG. 2.
Figure 4:
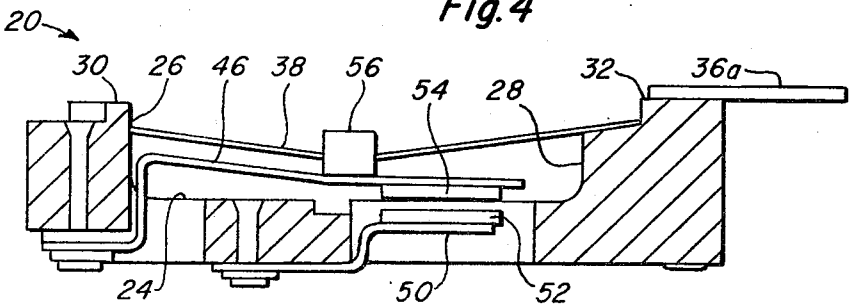
Fig.4 PRIOR ART
FIG. 4 is a side view of the prior art hot wire relay of FIG. 2.

Referring now to FIGS. 2–4 there is illustrated a prior art hot wire relay 20 manufactured and sold by King Seeley Thermostat Company, Ann Arbor, Mich. More particularly, relay 20 comprises a rigid, insulative base or frame 22 made of a ceramic material; the frame has a flat bottom 24 having a pair of end walls 26 and 28 extending up from the bottom forming a generally U-shaped opening. Top walls 30 and 32 are at approximately 90° angles with respect to walls 26 and 28, respectively. Conductive posts 34*a* and 34*b* pass through top wall 32. Terminals 36*a* and 36*b* are electrically connected to conductive posts 34*a* and 34*b*, respectively. A conductive wire 38, such as nichrome, is electrically connected to conductive post 34*a* and terminal 36*a* and is successively wound around nonconductive posts 40, 42 and 44 and is then connected to conductive post 34*b* and terminal 36*b*. Nichrome wire 38, by way of example, is approximately two mils in diameter. Switch arm 46 is electrically connected to terminal 48*a* (see FIG. 3) and switch arm 50 is electrically connected to terminal 48*b*. Switch arm 50 is stationary and has attached to it contact 52. Contact 54 is in engagement with switch arm 46 and is in line with and immediately above contact 52. A biasing member 56 is mechanically attached to upper switch arm 46 and has a plurality of grooves 58 through which nichrome wire 38 passes.

Switch arm 46 is preloaded (bent downward) in its normal position such that when the biasing member 56 is attached thereto, biasing member 56 biases or forces down the nichrome wire 38 into a shallow V position (seen more clearly in FIG. 4).

Nichrome wire has a property of thermal expansion in the range of $9\times10^{-6}$ inch/inch/°C. Accordingly, when a control current or signal is supplied to terminals 36*a* and 36*b* and passes through nichrome wire 38, nichrome wire 38 self-heats to a temperature in the range of 700° to 1000° F. This heat buildup is relatively quick since the wire is of low mass; with this heat buildup, wire 38 will expand along its total length and the V shape of the nichrome wire (caused by the force of the preloaded switch arm 46 and biasing member 56) gets deeper, thereby moving switch arm 46 downward and closing contacts 54 and 52. Contacts 54 and 52 will remain closed as long as a control current is applied to terminals 36*a* and 36*b*. When the control current is turned off, nichrome wire 38, being of very low mass and at a very high temperature, will cool down rapidly, thereby contracting in its length, causing contacts 54 and 52 to open.

This particular relay has the disadvantage of being a low voltage device and is not compatible with solid state electronics having line operating voltages. Many electronic controls or appliance control voltages are in the range of 24 to 27 volts or 120 to 140 volts. In order to operate this type of device at high line voltages, a voltage divider circuit would be required which creates additional expense. Furthermore, since the nichrome wire heats up to such a hot temperature (approximately 700° to 1000° F.), frame 22 is made of a ceramic material which also increases the cost of the relay. The thermal expression characteristic of $9\times10^{-6}$ inch/inch/°C. is very small and therefore requires large temperatures to obtain expansion of the wire and contact closure of the switch.

Figure 5:
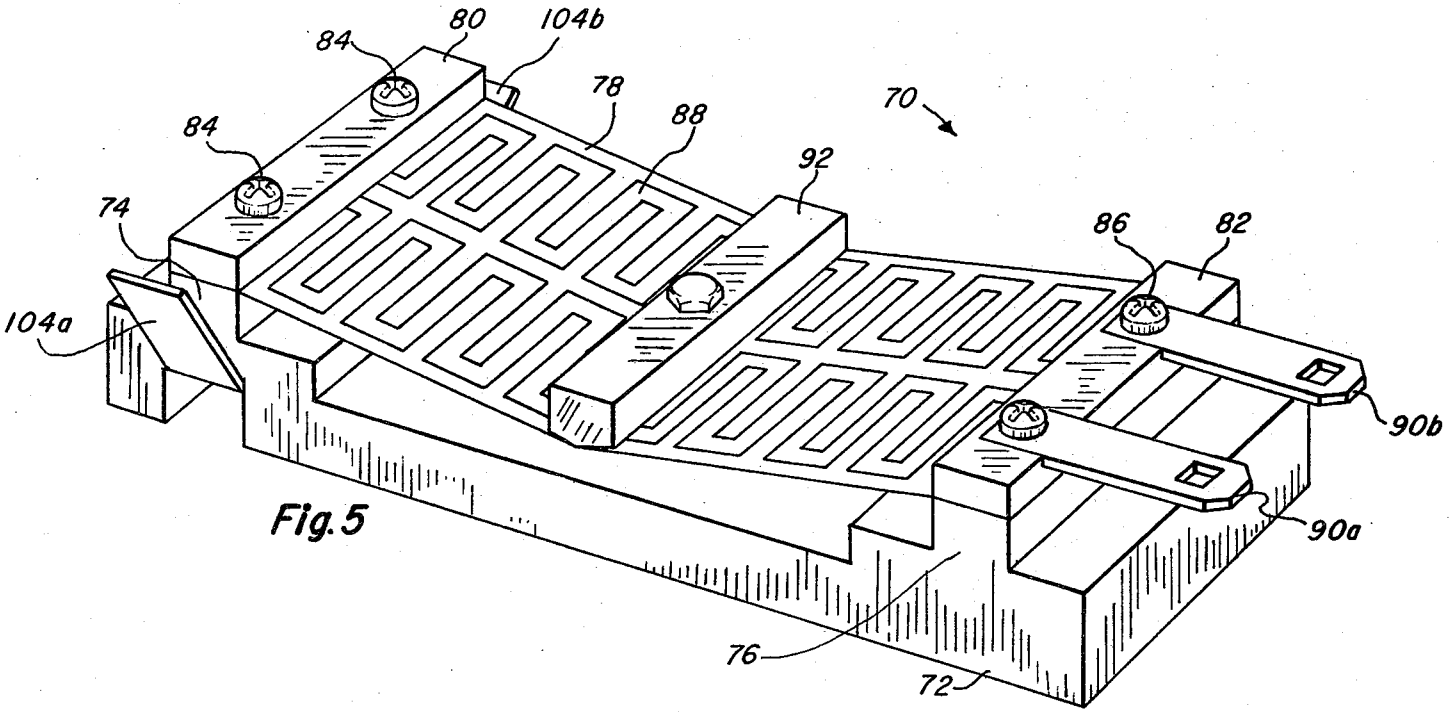
FIG. 5 is a top perspective view of the relay according to the present invention.

Referring now to FIG. 5, there is illustrated in its entirety an interface relay 70 constructed according to the present invention. Interface relay 70 comprises a rigid insulating base or frame 72 which can be made of phenolic or any other compatible material. Frame 72 has a pair of raised end members 74 and 76. A non-electrically conducted, flexible, thermally expansive substrate 78 is attached to the frame at end members 74 and 76. The thickness of substrate 78 may vary from one to ten mils but is preferably three mils thick. Substrate 78 may be made of polymeric material, such as, plastic or a polymide, polyester or silicone rubber material. A polymide which can be utilized as substrate 78 is sold under the trade name Kapton by the Dupont Company; a polyester capable of being used as substrate 78 is sold under the trade name Mylar by the Dupont Company. Substrate 78 is fixedly attached to frame 72 by two substrate attachment plates 80 and 82 which are secured to the frame by two sets of rivets or screws 84 and 86. An electric heating element 88 is in intimate contact with substrate 78 or formed directly on substrate 78. Although heating element 88 as illustrated in FIG. 5 is shown as having a serpentine shape, other configurations are equally acceptable with the design stipulation to have the heating element cover as much of the substrate material as possible; for example, the heating elements 88 could be comprised of continuous strips. Heating element 88 may be made of electrically conductive material, such as silver filled flexible resin, which is silk screened onto the substrate or may be made of any other flexible conductive compound, such as a conductive polyester, attached in a suitable manner. The heater element may also be made of nickel. Heater terminals 90*a* and 90*b* are electrically connected to heater element 88. These terminals in turn are connected to a low power input control circuit 12 (shown in FIG. 1).

Figure 6:
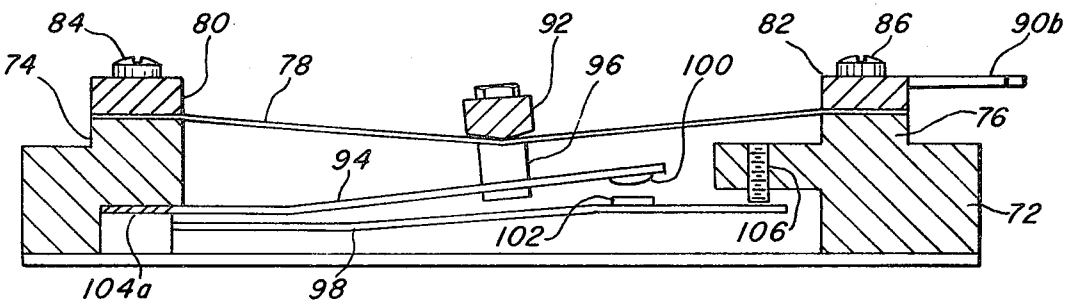
FIG. 6 is a side view of the relay according to the present invention.

Substrate 78 is stretched tightly across 72. Located approximately at the center of substrate 78 and traversing its width is a biasing member 92. Biasing member 92 is in contact with a pre-loaded mechanical member 94 through linkage 96; this is shown in FIG. 6. For purposes of the present embodiment, pre-loaded mechanical member 94 actually forms the movable switch arm of a switch assembly, the other arm of the switch assembly, whch is essentially stationary, is designated as switch arm 98. However, biasing member 92 and linkage 96 may be a mechanical member which transfers the motion of the substrate 78 and biasing member 92 to the movable snap switch arm. This will be described in more detail in the description of the embodiment of FIG. 10. Contacts 100 and 102 are attached to switch arms 94 and 98, respectively and overlie one another. Adjusting screw 106 (FIG. 6) varies the gap distance between contacts 100 and 102 to insure proper operation of the relay.

Figure 7:
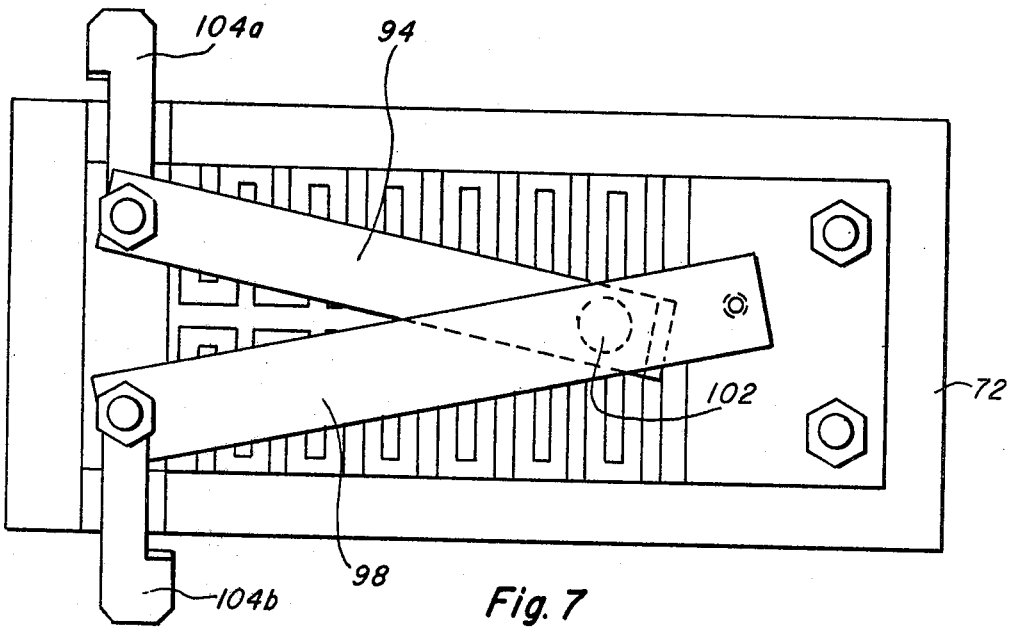
FIG. 7 is a bottom view of the relay according to the present invention.

Referring now to FIG. 7, it can be seen that switch arm 94 is electrically and mechanically connected to power terminal 104*a*, while stationary switch arm 98 is electrically and mechanically connected to terminal 104*b*. Terminals 104*a* and 104*b* are in turn electrically connected in the high voltage/current load circuit (shown in FIG. 1).

Pre-loaded mechanical member 94 exerts a downward force through linkage 96 and biasing member 92. This downward force which is transmitted across the total distance of biasing member 92 causes a "V" angle (in cross section) to form in substrate 78. This can be seen more clearly in FIG. 8*a*.

The operation of relay 70 can be more clearly understood by reference to FIGS. 8 and 9. The switch actuation displacement is generated by the expansion and contraction of the Kapton substrate 78 when such substrate is heated or allowed to cool. For purposes of explanation, FIG. 8*a* shows the outline of the substrate 78 attached to its ends. The "V" angle is produced by the downward force of biasing member 92. FIG. 8*a* illustrates the substrate 78 in the cold (no current applied to heating element 88). When current is applied to heating element 88, substrate 78 and apex 108*a* will have vertical displacement.

FIG. 8*b* shows more clearly the two conditions of the substrate 78 when in the cold (no current supplied to heating element 88) and the heated condition (when current is applied to heating element 88). When substrate 78 is heated, the substrate will expand causing apex 108*a* to move in a vertical direction from its position illustrated in FIG. 8*b* to the apex location shown at 108*b*. When current is applied to heater element 88 and the substrate expands, the substrate moves from its dotted line position to the solid line position producing an elongation and vertical displacement as shown.

Assuming substrate 78 is made of Kapton, the expansion rate of Kapton is $2\times10^{-5}$ inch per inch per °C. This displacement of the Kapton substrate in itself would not be adequate to operate a switch system; however, if the Kapton substrate 78 is placed in a shallow V shape as shown in FIG. 8*a*, a gain in center span vertical displacement can be achieved for a given elongation which is a function of the "V" angle. This can be illustrated more clearly by reference to FIGS. 9*a* and 9*b*.

Referring now to FIGS. 9*a* and 9*b*, we will assume that the substrate 78 is made of Kapton having an expansion rate of $2\times10^{-5}$ inch per inch per °C. and that the Kapton substrate is heated to a temperature differential of 200° C. and that the horizontal length of Kapton across the frame expanse is 3.0 inches (or as shown in FIGS. 9*a* and 9*b*, one half the horizontal distance is 1.50 inches). Referring specifically to FIG. 9*a*, in the cold substrate configuration, the vertical displacement is 0.0786 inches and the hypotenuse is 1.502 inches with a corner angle of three degrees. When the Kapton substrate 78 is heated, the hypotenuse will expand 0.006 inches to 1.508 inches, giving a vertical displacement of 0.154 inches and a corner angle of six degrees as shown in FIG. 9*b*.

The gain in the V shaped relay system is given as:

$$\text{Gain} = \frac{\text{vertical displacement (hot)} - \text{vertical displacement (cold)}}{\text{elongation (hot)} - \text{elongation (cold)}}$$

$$\text{Gain} = \frac{0.154 - 0.0786}{1.508 - 1.502} = 12.6$$

Going through these same type of trigonometric calculations for "V" angles of 168° (6° corner angle) and 162° (9° corner angle) gives gains of 9.0 and 7.0, respectively. Thus, it can be seen that the amplification of the vertical displacement falls off sharply as the "V" angle is reduced and if the "V" angle approaches 0°, the gain would approach 1.0. Thus, utilizing a shallow "V" angle provides a very large vertical motion amplification (which allows switch contacts 100 and 102 shown in FIG. 6 to readily close) for a small elongation of the Kapton substrate, or a reasonably good switch displacement for a small change in temperature.

A shallow "V" angle creates high stresses in substrate 78. Thus there is a practical limit to the shallow "V" angle due to the yield stress of the material. Desirably the "V" angle is in the range from 160° to 179°. Kapton is an excellent material for this application due to its high temperature and strength characteristics. Kapton's service temperature exceeds 260° C. while its tensile strength at 25° C. is 25,000 PSI and at 200° C. is 17,000 PSI. Desirably the heater element 88 is adapted to provide a temperature in the polyimide substrate 78 in the range from 60° F. to 400° F. when the heater element is energized.

FIG. 10 illustrates a relay 120 constructed according to the present invention but using a snap acting switch 122 rather than a creep switch (illustrated in FIGS. 5–7). Relay 120 is comprised of a substrate 124 having a heater thereon similar to substrate 78 and heating element 88 (illustrated in FIGS. 5–7). A biasing element 126 is mechanically coupled to a linkage 128 which in turn is connected to a spring member 130. Spring member 130 is preloaded in a downward position such that when it is connected to linkage 128 and biasing member 126, it forces biasing member 126 to exert a downward pressure on substrate 124 creating a "V" angle in substrate 124. Spring member 130 is mechanically connected to a motion transfer member 132 which in turn is connected to the leg of snap acting switch 120. A more complete description and theory of operation of snap acting switch 122 is disclosed in U.S. Pat. No. 2,503,008. Switch contact 134 is connected to movable switch arm 136. A stationary electrical contact 138 is connected to the frame of the relay.

The theory of operation of the relay illustrated in FIG. 10 is similar to that described in connection with FIGS. 5–7. When the electric heater on substrate 124 is heated, substrate 124 expands causing a downward vertical displacement of biasing element 126 and linkage 128 causing the spring member 130 to move downward. This downward motion is translated through motion transfer member 132 which causes movable switch arm 136 to move downward in a snap action, thereby providing electrical contact between contacts 134 and 138.

FIGS. 11*a* and 11*b* illustrate another embodiment of a relay 150 constructed according to the present invention. FIG. 11*a* illustrates the relay in its "open" position, i.e., electrical contacts 152*a* and 152*b* are not engaging one another whereas FIG. 11*b* illustrates the relay in its "closed" position, i.e., contacts 152*a* and 152*b* are in engagement with one another thereby completing the switch circuit.

Referring now to FIGS. 11*a* and 11*b*, there is illustrated a substrate 154 which is stretched across the length of the relay and attached at its ends to frame 170 by rivets 158. Electric heating element 156 (similar to heater element 88 illustrated in FIG. 5) is in intimate contact with said substrate. Substrate 154 and heater element 156 may be made of the same materials described in connection with the relays illustrated in FIGS. 5–7. Heater terminals 160*a* and 160*b* are in electrical contact with the electric heating element 156 on substrate 154. Mounting lobes 162*a* and 162*b* are used for mounting the relay to a working surface (not shown). Standoffs 164 are also used in the mounting process for maintaining a predetermined distance between the relay and the working surface.

Contacts 152*a* and 152*b* are connected to switch arms 168 and 166, respectively. Since arm 166 is connected to frame 170 by one of the rivets 158 and then forms switch terminal 172. Switch arm 168 is electrically connected to switch terminal 173. Switch arm 168 is of the snap acting type and can be seen more clearly illustrated in FIG. 13. Snap blade 168 (see FIG. 13) is comprised of three legs, two outer legs 174 and 176 and a center leg 178. Two elongated apertures 180 are cut in switch arm 168 and separate center leg 178 from outer legs 174 and 176; this switch arm, for example, may be made of high strength copper.

A biasing member 182 is illustrated in FIG. 12 and is comprised of two long members 184 extending down from its ends and a short member 186 extending downward from the center of the biasing member 182. Biasing member 182 may be made of phenolic or other suitable material. As can be seen more clearly in FIG. 13, the short member 186 of biasing member 182 rests on the center leg 178 of switch arm 168. The long members 184 of biasing member 182 are trapped in and moved up and down in slots or grooves 188 formed by sidewalls 190. The substrate 154 (shown in FIGS. 11*a* and 11*b*) has been omitted from FIG. 13 in order to show the other components of relay 150 with more clarity.

As can be seen in FIGS. 11*a* and 11*b*, biasing member 182 is in contact with the center of the underside of substrate 154 and generally traverses the width of substrate 154. When current is not supplied to heater terminals 160*a* and 160*b*, substrate 154 has a very small "V" angle due to the upward force created by biasing member 182 and the force transmitted by center leg 178 of movable snap blade 168. Short member 186 rests on the center leg 178 of switch arm 168. When pressure is applied on the center leg 178, causing the center leg 178 to pass through the center point of outer legs 176, the bend in the outer leg contracts and springs back causing the contacts 152*a* and 152*b* to be in the "open" position as shown in FIG. 11*a*. Frame stop 171 forming a part of frame 170 restricts the upper movement of movable switch arm 168.

When current is supplied to terminals 160*a* and 160*b* and therefore through heating element 156, substrate 154 expands. The center leg 178 of movable switch arm 168 (which was preloaded in the open contact position illustrated in FIG. 11*a*) will straighten out as substrate 154 elongates and return to its "at rest" position which is in an upward arc (see FIG. 11*b*). As the substrate 154 elongates, the center leg 178 of switch arm 168 exerts a force against the center member 186 of biasing member 182. As the center leg 178 goes back through the center point of outer legs 174 and 176, switch arm 168 will "snap back" to its "at rest" position causing contacts 152*a* and 152*b* to close (as shown in FIG. 11*b*). Biasing member 182 is forced upward and is guided by grooves 188 caused by side walls 190. Therefore, in the "closed" contact position shown in FIG. 11*b*, the substrate 154 increases its "V" angle when the switch changes states.

The relay constructed according to the present invention has a fast response since the mass of the substrate element is low so that little heat is stored in the substrate material and the surface area of the substrate is large which results in a fast convection heat loss and rapid cool down when current is removed from the heating elements. Furthermore, the heating element is part of the substrate and in intimate contact therewith which produces a large heat conduction area resulting in rapid heat buildup. The heating element is the driving force producing the thermal expansion in the substrate and the thermal expansion in the substrate produces the linear vertical displacement which produces a change in state of the switch contacts. The relay described according to the present invention has added flexibility in that it may operate with whatever voltages are available in the low power input control circuit 12 (shown in FIG. 1) even if this input circuit has available only high voltage supplies. The relay described herein can be modified in its design readily to accommodate different voltage requirements by altering the heater material utilized on the flexible substrate. This has the added advantage of conserving energy and reducing cost of additional components to drop the voltage down to something that is compatible with a low voltage relay device (such as that described in FIGS. 2–4).

Although the present invention has been shown and illustrated in terms of a specific apparatus, it will be apparent that changes or modifications can be made without departing from the spirit and scope of the invention as defined by the appended claims.

What is claimed is:

1. A surface element relay for changing the state of the switch contacts forming a part of a high current equipment circuit comprising:

a frame, a non-electrically conductive, flexible, thermally expansive substrate connected to said frame, electric heating element in contact with said substrate, a biasing member in contact with said substrate, a pre-loaded mechanical member in contact with said biasing member for producing a shallow V-shape in said substrate, and means for providing current to said heating element to produce heat resulting in thermal expansion and motion amplification in said substrate which is transmitted to said biasing member and said pre-loaded mechanical member thereby causing the switch contacts to change state.

2. A relay according to claim 1 wherein said substrate is formed of plastic.

3. A relay according to claim 1 wherein said substrate is polymide.

4. A relay according to claim 1 wherein said substrate is a polyester.

5. A relay according to claim 1 wherein said substrate is comprised of silicone rubber.

6. A relay according to claim 1 wherein said heating element has a serpentine configuration.

7. A relay according to claim 1 wherein said heating element is comprised of continuous strips.

8. A relay according to claim 1 wherein said heating element is made of nickel.

9. A relay according to claim 1 wherein said heating element is a flexible conductive compound.

10. A relay according to claim 3 wherein said heater element produces temperatures in the polymide in the range from 60° F. to 400° F.

11. A relay according to claim 1 wherein said "V" angle is in the range of 160° to 179°.

12. A relay according to claim 1 wherein said pre-loaded mechanical member comprises an arm of a switch.

13. A relay according to claim 1 wherein said pre-loaded mechanical member comprises a spring member exerting a downward force on said biasing means, said spring member being coupled to an arm of a switch.

14. A relay according to claim 1 wherein said biasing member is in contact with the center of said substrate.

15. A relay according to claim 12 wherein said switch is snap acting.

16. A relay according to claim 12 wherein said switch is creep acting.

17. In combination, a system comprising:

a low power input control circuit, a high voltage/current load circuit, a relay interface responsive to signals from said input control circuit for producing a change in state of switch contacts included in said load circuit, said relay interface comprising:

a frame, a non-electrically conductive, flexible, thermally expansive substrate connected to said frame, electric heating element in contact with said substrate, a biasing member exerting a force on said substrate, a pre-loaded mechanical member in contact with said biasing member for producing a shallow V-shape in said substrate, and means for providing current to said heating element to produce heat resulting in thermal expansion and motion amplification in said substrate which is transmitted to said biasing member and said pre-loaded mechanical member thereby causing the switch contacts to xhange state.

18. A surface element relay for changing the state of the switch contacts forming a part of a high current equipment circuit comprising:

a frame, said frame having a pair of grooves formed therein, a non-electrically conductive, flexible, thermally expansive substrate connected to said frame, electric heating element in contact with said substrate, a switch attached to said frame and comprised of a stationary blade and a movable blade, said movable blade comprised of two outer legs and a center leg, said center legs separated from said outer legs by two elongated apertures, a biasing member comprised of a flat portion in contact with said substrate, said flat portion having two outer members and a center member extending therefrom, said outer members positioned in said grooves and said center member resting on said center leg of said movable blade and forcing said center leg and movable blade into a first switch condition, and means for providing current to said heating element to produce heat resulting in thermal expansion and elongation in said substrate which is transmitted to said biasing member and movable switch blade resulting in a second switch condition.

19. A relay according to claim 18 wherein said substrate is formed of plastic.

20. A relay according to claim 18 wherein said substrate is polymide.

21. A relay according to claim 18 wherein said substrate is a polyester.

22. A relay according to claim 18 wherein said substrate is comprised of silicone rubber.

23. A relay according to claim 18 wherein said heating element has a serpentine configuration.

24. A relay according to claim 18 wherein said heating element is comprised of continuous strips.

25. A relay according to claim 18 wherein said heating element is made of nickel.

26. A relay according to claim 18 wherein said heating element is a flexible conductive compound.

27. A relay according to claim 20 wherein said heating element produces temperatures in the polymide in the range from 60° F. to 400° F.

28. A relay according to claim 18 wherein said biasing member is in contact with the center of said substrate and generally traverses the width of the substrate.

* * * * *